US006931681B2

(12) United States Patent
Allison et al.

(10) Patent No.: US 6,931,681 B2
(45) Date of Patent: Aug. 23, 2005

(54) MOTION ACCOMMODATING PATIENT CHAIR

(76) Inventors: Robbie Allison, 801 W. 6th St., McGregor, TX (US) 76657; Paul Allison, 801 W. 6th St., McGregor, TX (US) 76657; Lisa Martinez, 133 Bowie, Hewitt, TX (US) 76643

( * ) Notice: Subject to any disclaimer, the term of this patent is extended or adjusted under 35 U.S.C. 154(b) by 84 days.

(21) Appl. No.: 10/260,728

(22) Filed: Sep. 30, 2002

(65) Prior Publication Data

US 2004/0060114 A1 Apr. 1, 2004

(51) Int. Cl.[7] ..... A47B 7/00
(52) U.S. Cl. ..... 5/618; 5/600; 5/613
(58) Field of Search ..... 5/600, 601, 613, 5/617–618, 81.1 HS; 297/261.2, 259.3, 259.1, 337, 344.1, 344.11, 344.24

(56) References Cited

U.S. PATENT DOCUMENTS 1,686,145 A * 10/1928 Cook ..... 297/88
4,643,446 A * 2/1987 Murphy et al. ..... 280/648

* cited by examiner

*Primary Examiner*—Michael F. Trettel
*Assistant Examiner*—Fredrick Conley
(74) *Attorney, Agent, or Firm*—David G. Henry

(57) ABSTRACT

A patient support apparatus for supporting, and accommodating movement of patients with repetitive motion disorders. A chair of the present design will include a first sliding mechanism with carries a seat member along a range of motion relative to the over-all apparatus frame, and a second sliding mechanism for carrying the frame relative to a base. Either or both sliding mechanisms may be provided with shock absorbing or movement resistance features for further dampening a patient's movements.

2 Claims, 1 Drawing Sheet

MOTION ACCOMMODATING PATIENT CHAIR

BACKGROUND OF THE INVENTION

1. Field of the Invention

The present invention relates to medical equipment, and patient transport, support or immobilization devices in particular.

2. Background Information

Certain medical patients have neural, emotional and/or neuromuscular conditions which result in repetitive and substantially involuntary movement. This is often observed in patients who rock back and forth for hours at a time. For purposes of this discussion, all such disorders will be referenced as "repetitive motion disorders", regardless of their underlying causation or precise expression.

These same patients often have limited, if any, control over otherwise intentional movement. In other words, if they lose their balance, or otherwise began to fall from a bed or chair, they will not often be able to arrest their fall, and, in such cases (particularly with the elderly) serious injury usually follows.

Because of the propensity for injury, restraining patients as described above is a natural response on the part of hospital or rest home facility staff. However, this too can be injurious in its own way.

Restraining a patient to the point of preventing substantially any movement may result in the truly cruel effect of making the patient feel like the proverbial "caged animal." This may be true whether or not the patient can express this feeling (as often they could not because of their overall condition). This may even be exacerbated to the extent that the patient's repetitive movement is, at least in part, a product of an emotional disorder—the patient simply "must move" in order to dispense or prevent high levels of stress.

In addition to the emotional impact of restraint, there are physical hazards as well. Straps which hold a patient against a stationary surface (a bed, chair, etc.) can cause abrasions and sores. Merely being retained in a single, stationary position relative to a bed or chair can result in "bed sores."

No attention is known to have been directed in the patient care field in relation to accommodating patients with repetitive motion disorders, both in terms of their sense of emotional well-being and their safety.

The present inventors have determined that, in order to avoid the undesirable entrapment issues described above, as well as to provide for physical safety of patients with repetitive motion disorders, one must accomplish two primary objectives: (1) provide a patient support apparatus which safely supports the patient as against slips and falls resulting in unintended separation from the support apparatus; and (2) provide functionality for the apparatus which safely and smoothly accommodates, rather than impedes or resists the patient's movement.

SUMMARY OF THE INVENTION

In view of the foregoing, it is an object of the present invention to provide a patient support apparatus which is useful to persons with repetitive motion disorders.

It is another object of the present invention to provide a patient support apparatus for safely supporting a patient with a repetitive motion disorder.

It is another object of the present invention to provide a patient support apparatus for safely supporting a patient with a repetitive motion disorder, while accommodating the patient's movement.

It is another object of the present invention to provide a patient support apparatus for safely supporting a patient with a repetitive motion disorder, while reacting to the patient's movement in a way to avoid sudden stops or shifts in motion.

It is another object of the present invention to provide a patient support apparatus for safely supporting a patient with a repetitive motion disorder, while accommodating the patient's movement, to thereby obviate the necessity of rigid restraint as the means by which a patient is protected from movement resulting from unintentional separation from conventional patient support apparatuses (beds, chairs, wheelchairs, etc.).

It is another object of the present invention to provide a method for simultaneously supporting a patient with a repetitive motion disorder and accommodating their movement without undue restraint.

In satisfaction of each of these and related objects, the present invention teaches an apparatus and method of use thereof which safely supports a patient with repetitive motion disorder while accommodating their movement in such a way as to "cushion" or "absorb" the movement. Because the apparatus of the present invention reacts to, and accommodates the patients movement, rather than impedes such movement as with, for example, a stationary chair, the sudden differential movement relative to the support is avoided, the chance of accidental separation from the support is greatly lessened, and mere, substantially non-confining safety restraints are all that are required to safely retain the patient in-place.

With the non-restraining nature of the present patient support apparatus, and the accommodation, rather than resistance to the patient's movements, a patient who is conscious of a perceived need to move, as well as of active restraint will be considerably less stressed and more humanely treated.

DETAILED DESCRIPTION OF THE PREFERRED EMBODIMENT

Figure 1:
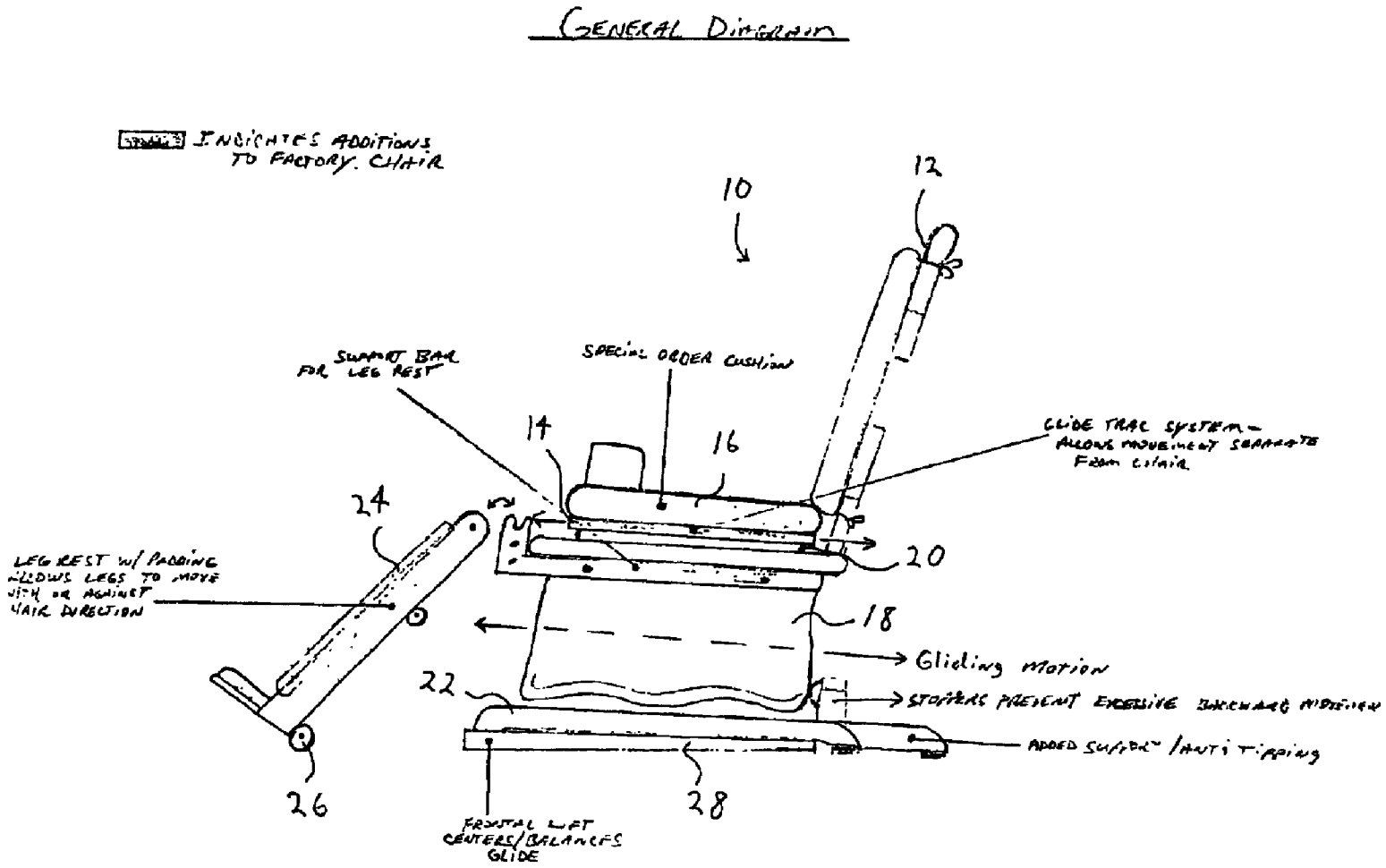
FIG. 1 is a side elevational view of a preferred embodiment of the present invention.

Referring to FIG. 1, the patient support apparatus of the present invention is identified generally by the reference number 10.

Patient support apparatus 10 is, in the preferred embodiment, configured as a chair, with a back member 12 and a seat member 14 with overlying cushion 16. Unlike a conventional chair, seat member 14 in Patient support apparatus 10 is not statically attached to the chair frame 18 (chair frame 18 is not shown in detail, as such details are irrelevant to the present invention). Seat member 14 is, instead, attached on each lateral side to a sliding member component of a sliding track device 20 (much like a drawer glide in the preferred embodiment). The stationary portion of sliding track device 20 is attached, directly or indirectly to chair frame 18.

The support of seat member 14 by sliding track device 20 allows seat member 14 to slide back and forth relative to the chair frame. In certain embodiments of the present invention, shock absorbing knobs (not shown in the drawings) placed on either end of the range of motion of the sliding member of the sliding track device 20 and/or motion resistance devices (springs, bungee cords, or the like—not shown in the drawings) may be associated with, or placed in proximity to seat member 14 to dampen motion to some degree.

In any event, a person seated upon cushion 16 and seat member 14, and who rocks back and forth, will set up a cyclical motion with seat member 14 moving forward and backward in response to the patient's movement.

A patient support apparatus 10 with only the features shown above would be beneficial to patients with repetitive motion disorders, but experimentation by the present inventors has shown that substantially greater beneficial results arise from including addition features.

A patient support apparatus 10 with movement accommodated only by the allowed sliding of seat member 14 tends to still allow somewhat abrupt changes of motion at either end of the range of motion of seat member 14. This, in turn, increases the likelihood that a patient might, in essence, throw themselves from the chair (or at least against safety restraints), especially at the end of a forward movement. To further accommodate and dampen a patient's movement, any preferred embodiment of the present invention will include a feature by which a second sliding motion is allowed. In the presently preferred embodiment, this is most simply achieved by supporting chair frame 18 on a second sliding track device 22 which slidably carries chair frame 18 relative to a base 28.

As with sliding track device 20, sliding track device 22 may take many forms, including rollers on chair frame 18 nested in tracks of base 28 or drawer glides, just to name two options. While space considerations render drawer glides the likely preferred choice for sliding track device 20, sliding track device 22 may be in any form which allows movement of the Patient support apparatus 10 in its entirety relative to the floor or ground surface upon which it rests. Structural considerations for this portion of the present invention is may be drawn from the various forms of "gliders" which have been long known in the furniture field.

Because abrupt changes in motion, or stops to motion are to be avoided, sliding track device 22 will, in most embodiments of the present invention, be provided with shock absorbing or partial motion-resisting apparatuses (not shown in the drawings). As above, these may take any number of form, or combinations thereof, and may include, for example, rubber bumpers, springs, elastic cords, and/or contoured tracks which rely on gravity to decelerate and arrest movement near each limit of motion.

Any preferred embodiment of the present invention will include a leg/foot support assembly 24, else a patient's legs (over which they likely will have little or no control in most cases) will interfere in the intended movement of the Patient support apparatus 10 during use. Leg/foot support assembly 24 should include wheels 26 which allow it, without substantial resistance, to move over the floor or ground surface, so as not to impede movement of the chair.

Any Patient support apparatus 10 constructed according to the present invention will accommodate a patient with repetitive motion disorders in the most humane and comfortable way possible. The two sliding actions described above combine to provide a very smooth rocking motion with no sudden reversal of direction or sudden stops.

Because the over-all structure and function of Patient support apparatus 10 results, in essence, in an "absorption" of the patients movement, the patient is simply unable to cause an acceleration of the surface on which he or she sits, such that a sudden stop or reversal of motion is possible. Nevertheless, the patient, from his or her perspective, is able to move in virtually any range or speed of motion without under hindrance. Actual experiments to date by the present inventors, show that this results in a considerable, and noticeable reduction in stress, and enhancement in apparent sense of well-being for patients with repetitive motion disorders. In addition, because the patient is not "fighting" or rubbing against stationary surfaces during their movement, abrasions and related injuries are avoided, or greatly reduced.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. Such changes or modifications may include, for example, variations in the sliding mechanisms for either or both of the systems described above, additional safety features, such as straps, side wings, etc., or chair pads which are contoured for more effectively cradling and supporting a patient with the most severe of voluntary control limitations. In addition, while the embodiment of the present invention has been shown as a chair, some applications may be desirable wherein a patient support member which does not necessarily include a seat and back in the conventional chair sense. Even a bed or other planer patient support surface may be designed or modified to incorporate the features described above. It is, therefore, contemplated that the appended claims will cover such modifications that fall within the scope of the invention.

We claim:

1. A patient support apparatus comprising:

a back member;

a seat member;

a patient support apparatus frame to which said back member is substantially statically attached;

a base member;

first sliding means for slidably carrying said seat member upon said patient support apparatus frame, said means for slidably carrying said seat member being configured for allowing motion of said seat member relative to said patient support apparatus frame over a first range of motion without affecting position of said back member; and second sliding means for slidably carrying said patient support apparatus frame relative to said base member.

2. A method for supporting a patient with repetitive motion disorder and accommodating such patient's movements without undue restraint, comprising the steps of:

selecting a patient support apparatus comprising:

a back member;

a seat member;

a patient support apparatus frame to which said back member is substantially statically attached;

a base member;

first sliding means for slidably carrying said seat member upon said patient support apparatus frame, said means for slidably carrying said seat member being configured for allowing motion of said seat member relative to said patient support apparatus frame over a first range of motion without affecting position of said back member;

second sliding means for slidably carrying said patient support apparatus frame relative to said base member; and lacing said patient upon said patient support apparatus and securing said patient therein by safety restraint means.

* * * * *